US006175197B1

(12) United States Patent
Kling

(10) Patent No.: US 6,175,197 B1
(45) **Date of Patent: *Jan. 16, 2001**

(54) ELECTRODELESS LAMP HAVING THERMAL BRIDGE BETWEEN TRANSFORMER CORE AND AMALGAM

(75) Inventor: Michael R. Kling, Stratham, NH (US)

(73) Assignee: Osram Sylvania Inc., Danvers, MA (US)

( * ) Notice: Under 35 U.S.C. 154(b), the term of this patent shall be extended for 0 days.

This patent is subject to a terminal disclaimer.

(21) Appl. No.: 08/949,630

(22) Filed: Oct. 14, 1997

(51) Int. Cl.[7] ..... H01J 65/04
(52) U.S. Cl. ..... 315/248; 315/344; 313/490
(58) Field of Search ..... 315/248, 344, 315/338; 313/492, 493, 490, 491

(56) References Cited

U.S. PATENT DOCUMENTS

| | | | |
|---|---|---|---|
| 3,500,118 | 3/1970 | Anderson | 315/57 |
| 3,987,334 | 10/1976 | Anderson | 315/57 |
| 4,298,828 | 11/1981 | Justice et al. | 315/248 |
| 5,239,238 | 8/1993 | Bergervoet et al. | 315/248 |

*Primary Examiner*—David Vu
(74) *Attorney, Agent, or Firm*—Carlo S. Bessone

(57) ABSTRACT

An electric lamp assembly includes an electrodeless lamp, including an electrodeless lamp envelope, a transformer core disposed in proximity to the lamp envelope and an input winding disposed on the transformer core. The lamp envelope preferably comprises a closed-loop, tubular lamp envelope, and the transformer is preferably disposed around the lamp envelope. The electrodeless lamp envelope encloses a fill material for supporting a low pressure discharge. The electrodeless lamp further includes an amalgam located within the lamp envelope. The input winding receives radio frequency energy which produces a low pressure discharge in the lamp envelope. The electrodeless lamp includes a thermal bridge between the transformer core and the amalgam, so that the amalgam is heated by the transformer core during operation.

18 Claims, 3 Drawing Sheets

ELECTRODELESS LAMP HAVING THERMAL BRIDGE BETWEEN TRANSFORMER CORE AND AMALGAM

FIELD OF THE INVENTION

This invention relates to low pressure, electrodeless discharge lamps and, more particularly, to electrodeless discharge lamps wherein the temperature of an amalgam is controlled by providing a thermal connection between the transformer core and the amalgam.

BACKGROUND OF THE INVENTION

Electrodeless fluorescent lamps are disclosed in U.S. Pat. No. 3,500,118 issued Mar. 10, 1970 to Anderson; U.S. Pat. No. 3,987,334 issued Oct. 19, 1976 to Anderson; and Anderson, *Illuminating Engineering,* April 1969, pages 236–244. An electrodeless, inductively-coupled lamp, as disclosed in these references, includes a low pressure mercury/buffer gas discharge in a discharge tube which forms a continuous, closed electrical path. The path of the discharge tube goes through the center of one or more toroidal ferrite cores such that the discharge tube becomes the secondary of a transformer. Power is coupled to the discharge by applying a sinusoidal voltage to a few turns of wire wound around the toroidal core that encircles the discharge tube. A current through the primary winding creates a time-varying magnetic flux which induces along the discharge tube a voltage that maintains the discharge. The inner surface of the discharge tube is coated with a phosphor which emits visible light when irradiated by photons emitted by the excited mercury atoms. The lamp parameters described by Anderson produce a lamp which has a high core loss and is therefore extremely inefficient. In addition, the Anderson lamp is impractically heavy because of the ferrite material used in the transformer core.

An electrodeless lamp assembly having high efficiency is disclosed in U.S. patent application Ser. No. 08/624,043, filed Mar. 27, 1996 (now U.S. Pat. No. 5,834,905). The disclosed lamp assembly comprises an electrodeless lamp including a closed-loop, tubular lamp envelope enclosing mercury vapor and a buffer gas at a pressure less than about 0.5 torr, a transformer core disposed around the lamp envelope, an input winding disposed on the transformer core and a radio frequency power source coupled to the input winding. The radio frequency power source typically has a frequency in a range of about 100 kHz to about 400 kHz. The radio frequency source supplies sufficient radio frequency energy to the mercury vapor and the buffer gas to produce in the lamp envelope a discharge having a discharge current equal to or greater than about 2 amperes. The disclosed lamp assembly achieves relatively high lumen output, high efficacy and high axial lumen density simultaneously, thus making it an attractive alternative to conventional VHO fluorescent lamps and high intensity, high pressure discharge lamps.

Another type of electrodeless lamp is disclosed in U.S. Pat. No. 4,298,828 issued Nov. 3, 1981 to Justice et al. A globe-shaped lamp, wherein the discharge path is irregular in shape and is confined to an approximately spherical lamp envelope, is disclosed. A transformer core is located within the lamp envelope.

Yet another type of electrodeless lamp is disclosed in U.S. Pat. No. 5,239,238 issued Aug. 24, 1993 to Bergervoet et al. A transformer core is positioned in a reentrant cavity of a generally globe-shaped electrodeless lamp envelope.

The high wall temperatures of the lamp envelopes in the aboved-scribed lamps necessitates the use of mercury amalgams to ensure near optimum mercury vapor pressure during typical operation. Amalgams also have the advantage of substantially increasing the useful temperature range of the lamps. However, under some conditions, the amalgam temperature can drop below the optimum temperature range. In this case, output lumens and efficacy drop, and lamp color can shift due to the drop in mercury vapor pressure. These undesirable changes can occur in globe-shaped lamps, which do not have an integral ballast to provide amalgam heating, and also in tubular lamps. Temperatures below optimum can occur when lamp power is reduced during dimming and in low ambient temperatures, and also when the lamp is operated outside a fixture.

In tubular electrodeless lamps, the most practical location for the amalgam is in the exhaust or dummy tubulation. With lamps of typical loading operating in an indoor enclosed fixture, the amalgam temperature reaches about 85° C. to 95° C., well within the temperature range which gives lumens greater than 90% of peak. However for outdoor use, it is desirable to maintain high lumen output down to minus 20° C. or lower. Under these conditions, lumen output can drop far below peak. Also, in open air at normal room temperature of 25° C., the amalgam drops to below the temperature range that gives a lumen output greater than 90% of peak for common amalgam systems based on bismuth, tin and lead or bismuth and indium.

Accordingly, it is desirable to provide electrodeless lamp configurations and methods of operating electrodeless lamps which provide high lumen output over a wide range of operating temperatures.

SUMMARY OF THE INVENTION

According to a first aspect of the invention, an electric lamp assembly is provided. The lamp assembly comprises an electrodeless lamp including an electrodeless lamp envelope, a transformer core, disposed in proximity to the lamp envelope and an input winding disposed on the transformer core. The electrodeless lamp envelope encloses a fill material for supporting a low pressure discharge. The electrodeless lamp further includes an amalgam located within the lamp envelope. The input winding receives radio frequency energy from a radio frequency source. The radio frequency energy produces a low pressure discharge in the lamp envelope. The lamp envelope further comprises a thermal connection between the transformer core and the amalgam, wherein the amalgam is heated by the transformer core during operation.

In a preferred embodiment, the lamp envelope comprises a closed-loop, tubular lamp envelope, and the transformer core is disposed around the lamp envelope. The amalgam may be located in an exhaust tubulation of the lamp envelope, and the thermal connection may comprise a thermal bridge between the transformer core and the exhaust tubulation. The thermal bridge may comprise a thermally-conductive metal or a thermally-conductive cement in thermal contact with the transformer core and the exhaust tubulation. The lamp assembly may further include a core retainer disposed around the transformer core. In this configuration, the thermal connection between the transformer core and the amalgam may comprise a thermal connection between the core retainer and the exhaust tubulation. In another embodiment, the amalgam is located in close proximity to the transformer core, and thermal energy is transferred from the transformer core to the amalgam through the lamp envelope.

According to another aspect of the invention, an electrodeless lamp assembly is provided. The lamp assembly comprises an electrodeless lamp including a closed-loop, tubular lamp envelope, a transformer core disposed around the lamp envelope, an input winding disposed on the transformer core and a radio frequency power source coupled to the input winding. The lamp envelope encloses mercury vapor and a buffer gas. The electrodeless lamp further includes an amalgam located within the lamp envelope. The radio frequency power source supplies sufficient radio frequency energy to the electrodeless lamp to produce a low pressure discharge in the lamp envelope. The lamp assembly further comprises a thermal connection between the transformer core and the amalgam, wherein the amalgam is heated by the transformer core during operation.

According to a further aspect of the invention, a method for operating an electric lamp assembly is provided. The lamp assembly comprises an electrodeless lamp including an electrodeless lamp envelope enclosing a fill material for supporting a low pressure discharge, a transformer core disposed in proximity to the lamp envelope and an input winding disposed on the transformer core. The electrodeless lamp further includes an amalgam located within the lamp envelope. The method comprises the steps of supplying radio frequency energy to the input winding, the radio frequency energy producing a low pressure discharge in the lamp envelope, and controlling the temperature of the amalgam by coupling thermal energy from the transformer core to the amalgam during operation of the lamp assembly.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
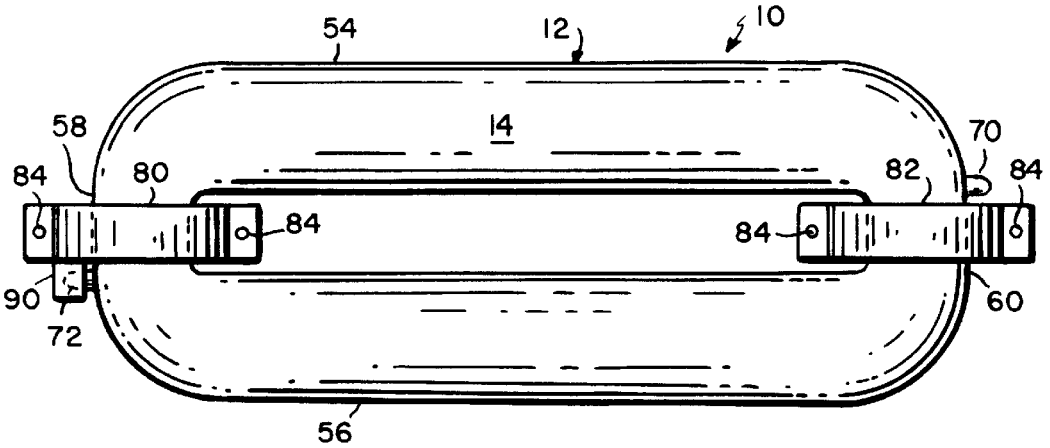
FIG. 1 is a plan view of an electrodeless lamp assembly in accordance with the invention.

An example of a discharge lamp in accordance with the present invention is shown in FIGS. 1–4. An electrodeless lamp 10 includes a lamp envelope 12 which has a tubular, closed-loop configuration and is electrodeless. The lamp envelope 12 encloses a discharge region 14 containing a buffer gas and mercury vapor. A phosphor coating may be formed on the inside surface of lamp envelope 12. Radio frequency (RF) energy from an RF source 20 (FIG. 3) is inductively coupled to the electrodeless lamp 10 by a first transformer core 22 and a second transformer core 24. Each of the transformer cores 22 and 24 preferably has a toroidal configuration that surrounds lamp envelope 12. The RF source 20 is connected to a winding 30 on first transformer core 22 and is connected to a winding 32 on second transformer core 24. Conductive strips 26 and 28, adhered to the outer surface of lamp envelope 12 and electrically connected to opposite leads 27 and 29, respectively, of RF source 20, may be utilized to assist in starting a low pressure discharge in electrodeless lamp 10. Conductive strips 26 and 28 may be electrically isolated from transformer cores 22 and 24, respectively, by an insulating foam or other insulator.

Figure 3:
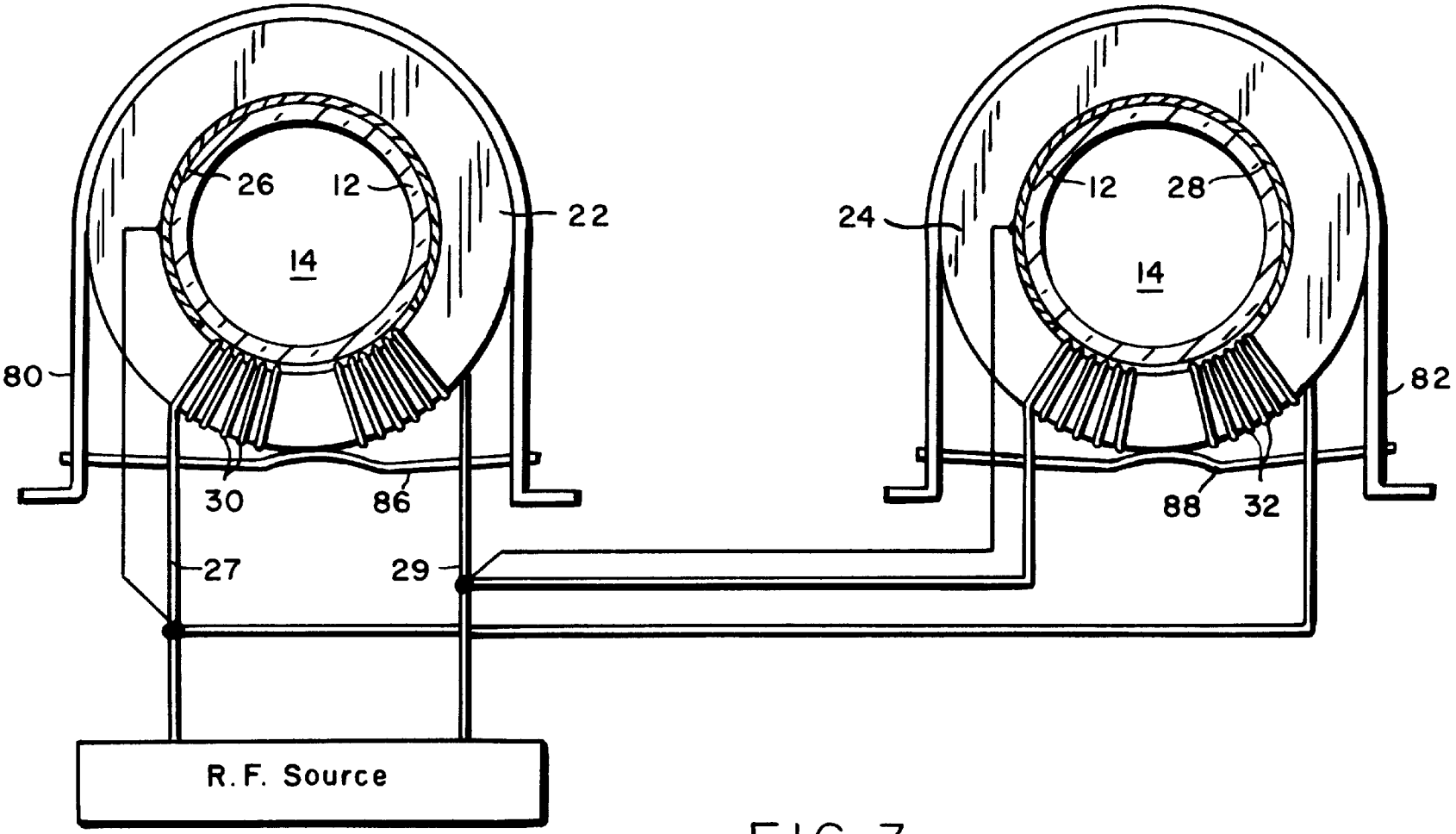
FIG. 3 is a schematic diagram of the core subassembly used in the electrodeless lamp assembly of FIGS. 1 and 2.

In operation, RF energy is inductively coupled to a low pressure discharge within lamp envelope 12 by transformer cores 22 and 24. The electrodeless lamp 10 acts as a secondary circuit for each transformer. The windings 30 and 32 are preferably driven in phase and may be connected in parallel as shown in FIG. 3. The transformer cores 22 and 24 are positioned on lamp envelope 12 such that the voltages induced in the discharge by the transformer cores 22 and 24 add. The RF current through the windings 30 and 32 creates a time-varying magnetic flux which induces along the lamp envelope a voltage that maintains a discharge. The discharge within lamp envelope 12 emits ultraviolet radiation which stimulates emission of visible light by the phosphor coating. In this configuration, the lamp envelope 12 is fabricated of a material, such as glass, that transmits visible light. In an alternative configuration, the electrodeless lamp is used as a source of ultraviolet radiation. In this configuration, the phosphor coating is omitted, and the lamp envelope 12 is fabricated of an ultraviolet-transmissive material, such as quartz.

Figure 2:
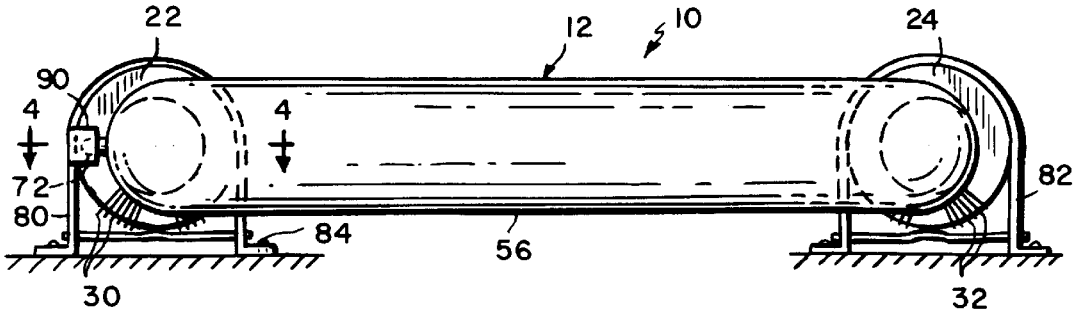
FIG. 2 is a side view of the electrodeless lamp assembly of FIG. 1.

The lamp envelope preferably has a cross-sectional diameter in a range of about 1 inch to about 4 inches for high lumen output. The fill material comprises a buffer gas and a small amount of mercury which produces mercury vapor. The buffer gas is preferably a noble gas and is most preferably krypton. It has been found that krypton provides higher lumens per waft in the operation of the lamp at moderate power loading. At higher power loading, use of argon may be preferable. The lamp envelope 12 can have any shape which forms a closed loop, including an oval shape, a circular shape, an elliptical shape or a series of straight tubes joined to form a closed loop. In the example of FIGS. 1–3, lamp envelope 12 includes two straight tubes 54 and 56 in a parallel configuration. The tubes 54 and 56 are interconnected at or near one end by a lateral tube 58 and are interconnected at or near the other end by a lateral tube 60. Each of the lateral tubes, or bridges, 58 and 60 provides gas communication between straight tubes 54 and 56, thereby forming a closed-loop configuration. The straight tubes 54 and 56 have an advantage over other shapes in that they are easy to make and easy to coat with phosphor. The transformer core 22 is mounted around bridge 58, and transformer core 24 is mounted around bridge 60. In a preferred embodiment, straight tubes 54 and 56 have a larger diameter than bridges 58 and 60. Straight tube 54 includes an exhaust tubulation 70, and straight tube 56 includes an exhaust tubulation 72.

The transformer cores 22 and 24 are preferably fabricated of a high permeability, low-loss ferrite material, such as manganese zinc ferrite. The transformers cores 22 and 24 form a closed loop around lamp envelope 12 and typically have a toroidal configuration, with an inside diameter that is slightly larger than the outside diameter of lamp envelope 12. The windings 30 and 32 may each comprise a few turns of wire of sufficient size to carry the primary current. Each transformer is configured to step down the primary voltage and to step up the primary current, typically by a factor of about 5 to 25. The RF source 20 is preferably in a range of about 50 kHz to about 3 MHz and is most preferably in a range of about 100 kHz to about 400 kHz.

The discharge lamp may further include a core retainer 80 around transformer core 22 and a core retainer 82 around transformer core 24. Each core retainer 80, 82 may be in the form of a generally U-shaped metal band having mounting holes 84 for securing the respective transformer cores in fixed positions, for example, in a lamp fixture. The core retainers 80 and 82 may be secured on transformer cores 22 and 24 by springs 86 and 88, respectively. The core retainers 80 and 82 and the springs 86 and 88 hold the split transformer cores together around the lamp envelope 12.

The electrodeless lamp 10 preferably includes an amalgam for controlling the mercury vapor pressure within lamp envelope 12 and for providing a more constant lumen output over a range of temperatures. The amalgam may, for example, include bismuth, tin, lead and mercury. The amalgam may be located within one of the exhaust tubulations, such as exhaust tubulation 72. Suitable amalgam compositions are known to those of skill in the art. The amalgam may be located at other positions within lamp envelope 12 within the scope of the present invention.

In accordance with the invention, one of the transformer cores is thermally connected to the amalgam so that the amalgam is heated by thermal energy generated in the transformer core or conducted from the lamp 10 to the transformer core during operation. As described below, the thermal connection may be a thermal bridge of a thermally-conductive material or may result from close proximity of the amalgam to the transformer core. Preferably, the amalgam is located as close as is practical to the transformer core. This may be accomplished by locating the exhaust tubulation containing the amalgam adjacent to the transformer core or within the transformer core.

Typical ferrites used for transformer cores in electrodeless lamps have minimum core loss at temperatures below 100° C. Core loss is also strongly dependent on flux density, which is a function of core cross section and primary voltage. Core loss increases rapidly with increasing primary voltage to the input winding. Because of the high cost of ferrite material, the cross section of the transformer core is kept to a minimum. The combination of core self-heating due to losses and heat from the lamp results in a core temperature during normal lamp operation of about 100° C. to 140° C. Conveniently, this range is near the upper useful temperature limit of amalgams such as bismuth: indium and bismuth: tin: lead.

An example of the thermal connection, or thermal bridge, between the transformer core and the amalgam is shown in FIGS. 1 and 2. A thermally conductive tab 90 is welded or otherwise mechanically attached to core retainer 80. The tab 90, which functions as a thermal bridge, may, for example, be aluminum. The tab 90 is formed around the exhaust tubulation 72 and conducts thermal energy from transformer core 22 to an amalgam located within exhaust tubulation 72, thereby heating the amalgam above the temperature which results in the absence of the thermal bridge.

Under nearly all conditions, the ferrite transformer cores are at a higher temperature than the amalgam in the exhaust tubulation. The immediate effect of heating the amalgam is to shift the useful ambient temperature range of the discharge lamp to a lower region. This is beneficial for most applications, since the temperature for obtaining optimal lumen output is above the temperature found in typical lamp fixtures. This is especially true for fixtures used in low ambient temperature.

Another benefit of the thermal bridge occurs in dimming applications. When wall loading drops as the lamp is dimmed, the exhaust tubulation temperature also drops and approaches ambient temperature. Under these conditions, the mercury vapor pressure is far below optimum, producing noticeable color shifts and poor efficacy. However, as discharge current drops, the discharge voltages increases. This increases the flux density in the cores and causes core losses to increase. The increase in core losses can effectively offset the decrease in heat from the lamp and the lower core ambient temperature. When the amalgam in the exhaust tubulation is heated by the transformer core, the adverse effects of dimming are reduced.

A third benefit of the thermal bridge relates to lumen output upon restarting of the lamp. Amalgam lamps usually require an auxiliary amalgam located within the discharge. An indium-plated flag, which heats rapidly after ignition and releases sufficient mercury to give fast lumen increase, or runup, is typically used. The lumen runup is limited only by the lamp envelope warmup rate and diffusion time through the discharge. For fast lumen runup, the flag must contain a quantity of mercury greater than is present in the gas during operation. Therefore, after lamp turnoff, insufficient mercury is available in the lamp discharge region. Mercury must diffuse from the main amalgam to the flag over a period of time. When a normal lamp is extinguished, the amalgam in the exhaust tubulation is the cold spot. The exhaust tubulation also cools faster than the rest of the lamp. Thus, mercury transport from the main amalgam to the flag is slow. Short off times typically result in slow lumen runup after restart. However, the transformer cores have a high heat capacity relative to the rest of the lamp. By providing a thermal bridge between the transformer core and the amalgam, the main amalgam cools more slowly than other lamp parts. This drives mercury out of the main amalgam and accelerates equilibration with the flag, thereby increasing the lumen runup rate after restart.

Figure 4:
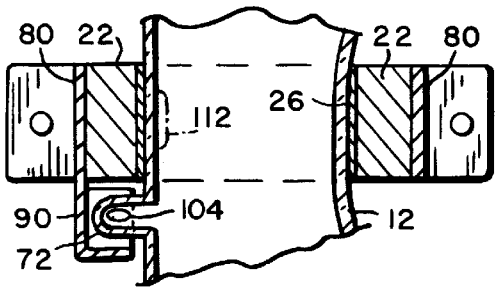
FIG. 4 is an enlarged, partial cross-sectional view of the electrodeless lamp assembly of FIGS. 1 and 2.

An enlarged, partial cross-sectional view of lamp envelope 12 and exhaust tubulation 72 is shown in FIG. 4. Exhaust tubulation 72 contains an amalgam 104. Transformer core 22 is disposed around lamp envelope 12 in close proximity to exhaust tubulation 72. Thermal bridge 90 is attached between core retainer 80 and exhaust tubulation 72, thus providing a thermal connection between transformer core 22 and amalgam 104. Alternatively, the thermal bridge may be connected directly between exhaust tubulation 72 and the transformer core. The thermal bridge 90 is fabricated of a thermally-conductive material, such as a thermally-conductive metal or a thermally-conductive cement, and is secured so as to provide a thermal path between transformer core 106 and amalgam 104. The transformer core 22 and the exhaust tubulation 72 should be in relatively close proximity, preferably less than about 5 centimeters. In some cases, a separate thermal bridge may not be required for efficient thermal transfer between transformer core 22 and the amalgam. For example, an amalgam 112 may optionally be located on the inside surface of lamp envelope 12 adjacent to transformer core 22. In this case, conduction of thermal energy from transformer core 22 to amalgam 112 through the wall of lamp envelope 12 produces sufficient heating of amalgam 112 to obtain the improved performance described herein.

In a first example of an electrodeless discharge lamp in accordance with the invention, the lamp envelope is made of 50 millimeter outside diameter Pyrex glass having a composition of 81% $SiO_2$, 13% $B_2O_3$, 4%$Na_2O$ and 2%$Al_2O_3$ enclosing a discharge volume in the form of an elongated torpid. The gas fill includes 0.3 torr krypton and 10 milligrams (mg) of mercury which is amalgamated with 300 mg of an alloy of bismuth:tin:lead in a ratio of 46:34:20 by weight. The amalgam is located in an exhaust tubulation opposite the vacuum tubulation. The lamp envelope is provided with a layer of phosphor material. The bridge region at each end of the lamp is not phosphor coated.

The transformer cores 22 and 24 are VOGT Fi325 material of size R61, which have been cut in half. Each core has a primary winding of eleven turns. The primary windings are connected in parallel to RF source 20 and may be number 24 Teflon insulated copper wire.

Aluminum foil bands 26 and 28 are applied over the lamp bridges 58 and 60 and are electrically connected to opposite leads of RF source 20, as shown in FIG. 3. A layer of silicon foam is used to electrically insulate the transformer cores from the aluminum foil starting aids. Aluminum core retainers 80 and 82 and leaf springs 86 and 88 hold the respective cores together. The core retainers 80 and 82 also conduct heat from the core to the lamp fixture. Tab 90 functions as a thermal bridge between the amalgam in exhaust tubulation 72 and transformer core 22.

The RF source 20 has an output frequency in a range of 200 kHz to 300 kHz and operates the lamp at about 140 watts when the lamp is equilibrated. The RF source 20 provides a high initial voltage to ensure fast starting.

The above-described lamp must operate both indoors and outdoors over a wide ambient temperature range. The local temperature inside the fixture is expected to range from about 0° C. to about 80° C. A high lumen output is desired over as much of this range as is possible. It is also preferable to obtain near maximum lumen output at normal room temperature of 25° C.

The relative lumen output of an electrodeless discharge lamp of the construction described in the above example was measured over a range of ambient temperatures. The test was initially run with an exposed exhaust tubulation. The test was then repeated with a 0.375 inch outside diameter by 0.030 inch wall thickness by 0.9 inch long copper tube over the exhaust tubulation containing the amalgam. The copper tube was connected to the core retainer with a 1 inch long by 0.3 inch wide by 0.020 inch thick copper strip. The results are plotted in FIG. 5, which shows relative lumen output as a function of ambient temperature. Curve 130 indicates the measurement results without a thermal bridge between the transformer core and the amalgam, whereas curve 132 indicates the results with the above-described thermal bridge between the transformer core and the amalgam.

Figure 5:
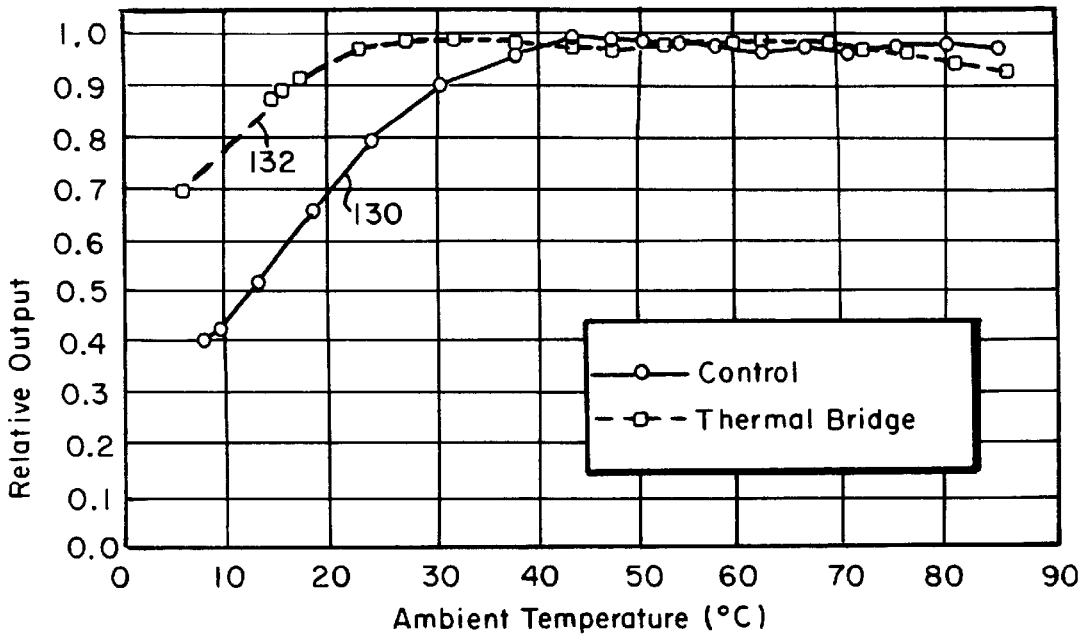
FIG. 5 is a graph of relative lumen output as a function of temperature for electrodeless lamps with and without a thermal bridge in accordance with the invention.

It is apparent from FIG. 5 that the thermal bridge substantially improves the low temperature performance of the lamp, with only a slight drop in output at high temperatures. The useful temperature range, defined by the range over which the lumen output is greater than 90% of peak, is increased by 15° (from 31° C. to greater than 80° C. without the thermal bridge to 16° C. to greater than 80° C. with the thermal bridge), assuming that fixture temperatures above 80° C. are not encountered. Furthermore, the relative lumen output at 25° C. is increased from about 82% of peak to about 98% of peak using the thermal bridge.

Dimming is a desirable feature of the above-described electrodeless discharge lamp. However, amalgam lamps typically do not behave well when dimmed. At low power levels, much less heat is generated in the fixture, and the amalgam temperature can drop to nearly ambient temperature. Problems are caused by the low mercury vapor pressure that results when power is reduced. Discharge efficacy drops sharply, and there is a pronounced color shift. These effects are more pronounced with amalgam lamps than with typical mercury lamps.

An electrodeless discharge lamp of the construction described in the above example was tested in a simulated fixture with lamp power varied from 140 watts down to 40 watts. The test was first conducted with a copper thermal bridge identical to that used for the lumen versus temperature test. The test was then repeated with the thermal bridge removed. To ensure a fair test, the amalgam tubulation was covered with insulation so that the amalgam temperature without the thermal bridge was approximately equal to the temperature with the bridge.

Figure 6:
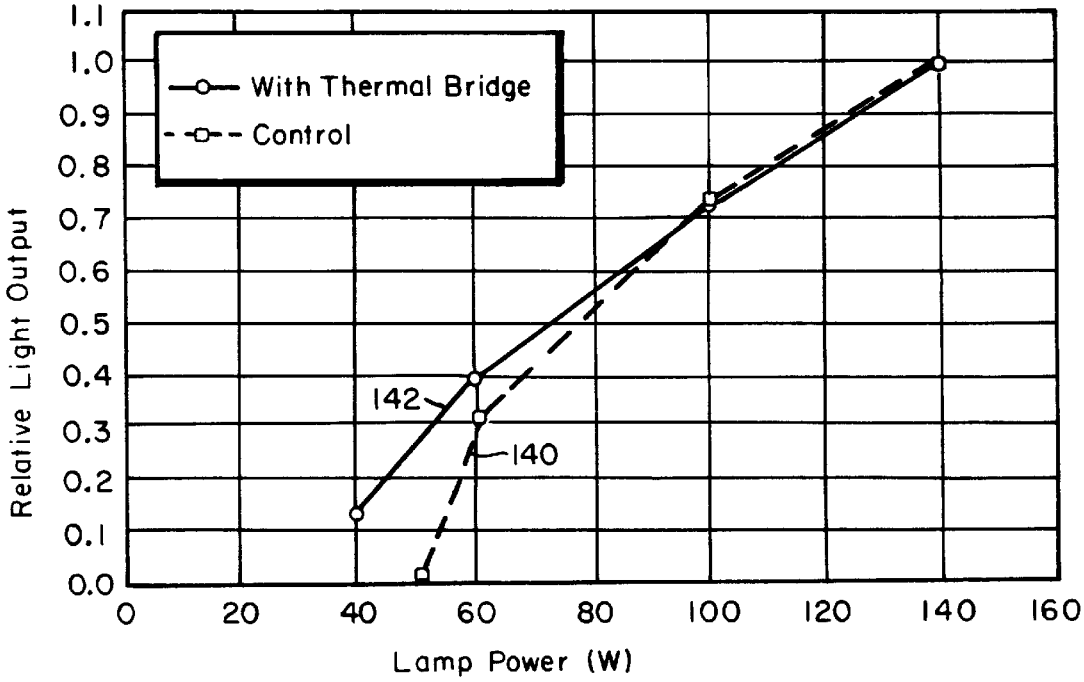
FIG. 6 is a graph of relative lumen output as a function of power for electrodeless lamps with and without a thermal bridge in accordance with the invention.

Relative lumen output is plotted as a function of lamp power in FIG. 6. Curve 140 represents the results without the thermal bridge, and curve 142 represents the results with the thermal bridge. The efficacy at low power is higher when the thermal bridge is used. In fact, a substantially lower lamp power was attainable when the thermal bridge was used. Without the thermal bridge, instability occurred at slightly below 60° C. and output dropped sharply to near zero.

A third benefit of the thermal bridge is improved lumen runup after turn on. Lumen runup of a typical electrodeless discharge lamp was measured with and without a thermal bridge as described above. The lamp was operated for about 2 hours and then turned off. After one hour, the lamp was started and the time to reach 90% of peak lumen output was recorded. The test was then repeated, but with the thermal bridge removed immediately after turning the lamp off. Lumen runup time increased from 67 seconds with the thermal bridge to 133 seconds without the thermal bridge.

A second example of an electrodeless discharge lamp in accordance with the invention is now described. The second example is similar in construction to the first example described above. The differences in construction are set forth below. In the second example, the lamp envelope is made of 54 mm outside diameter Pyrex glass. The gas fill includes 0.25 torr krypton and 15 mg of mercury, which is amalgamated with 400 mg of bismuth indium eutectic. The transformer cores are Siemens N87 material with an outer diameter of about 64 mm, an inner diameter of about 41 mm and a width of 18 mm. The cores are cut in half. Each core has primary winding of 18 turns of number 24 Teflon insulated wire. The windings are connected in parallel. The foil bands are not used in the second example. Instead, the wire ends from one core are taped to the lamp envelope using transparent FEP tape. During starting, the full open circuit voltage of RF source 20 is applied across these wires, which are capacitively coupled to the lamp. The thermal bridge is made of a stamped aluminum piece that is formed into a tube with a tab extending from one end. The tube slides over the amalgam-containing tubulation, and the tab extends along the lamp envelope surface and contacts the transformer core, either beneath the core or on the side of the core.

The use of a thermal bridge has been described in connection with an electrodeless discharge lamp having a closed-loop, tubular lamp envelope, wherein a transformer core is disposed around a lamp envelope. It will be understood that the present invention may be applied to any low pressure electrodeless discharge lamp wherein electrical energy is coupled to a low pressure discharge using a transformer core. The transformer core may, for example, be located within the lamp envelope, within a reentrant cavity of the lamp envelope or otherwise in proximity to the lamp envelope. In each case, a thermal connection is provided between the transformer core and an amalgam, so that the amalgam is heated by the transformer core during operation.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp assembly comprising:

an electrodeless lamp including an electrodeless lamp envelope enclosing a fill material for supporting a low pressure discharge, said electrodeless lamp further including an amalgam located within said lamp envelope;

a transformer core disposed in proximity to said lamp envelope;

an input winding disposed on said transformer core for receiving radio frequency energy from a radio frequency source, said radio frequency energy producing said low pressure discharge in said lamp envelope; and a thermal connection comprising a heat-conducting material disposed between said transformer core and said amalgam, wherein said amalgam is heated by said transformer core during operation.

2. An electric lamp assembly as defined in claim 1 wherein said lamp envelope comprises a closed-loop, tubular lamp envelope and wherein said transformer core is disposed around said lamp envelope.

3. An electric lamp assembly as defined in claim 2 wherein said amalgam is located in an exhaust tubulation of said lamp envelope and wherein said thermal connection comprises a thermal bridge between said transformer core and said exhaust tubulation.

4. An electric lamp assembly as defined in claim 3 wherein said thermal bridge comprises a thermally-conductive metal in thermal contact with said transformer core and said exhaust tubulation.

5. An electric lamp assembly as defined in claim 3 wherein said thermal bridge comprises a thermally-conductive cement in thermal contact with said transformer core and said exhaust tubulation.

6. An electric lamp assembly as defined in claim 2 wherein said amalgam is located in an exhaust tubulation of said lamp envelope and wherein said thermal connection comprises thermal contact between said transformer core and said exhaust tubulation.

7. An electric lamp assembly as defined in claim 2 wherein said amalgam is located in an exhaust tubulation of said lamp envelope and wherein said exhaust tubulation is located within about 5 centimeters of said transformer core.

8. An electric lamp assembly as defined in claim 2 wherein said amalgam is located in an exhaust tubulation of said lamp envelope and wherein said lamp assembly further comprises a core retainer disposed around said transformer core, said thermal connection between said transformer core and said amalgam comprising a thermal connection between said core retainer and said exhaust tubulation.

9. An electric lamp assembly as defined in claim 1 wherein said amalgam is located in close proximity to said transformer core, wherein thermal energy is transferred from said transformer core to said amalgam through said lamp envelope.

10. An electrodeless lamp assembly comprising:

an electrodeless lamp including a closed-loop, tubular lamp envelope enclosing mercury vapor and a buffer gas, said electrodeless lamp further including an amalgam located within said lamp envelope;

a transformer core disposed around said lamp envelope;

an input winding disposed on said transformer core;

a radio frequency power source coupled to said input winding for supplying sufficient radio frequency energy to said electrodeless lamp to produce a low pressure discharge in said lamp envelope; and a thermal connection comprising a heat-conducting material disposed between said transformer core and said amalgam, wherein said amalgam is heated by said transformer core during operation.

11. An electrodeless lamp assembly as defined in claim 10 wherein said amalgam is located in an exhaust tubulation of said lamp envelope and wherein said thermal connection comprises a thermal bridge between said transformer core and said exhaust tubulation.

12. An electrodeless lamp assembly as defined in claim 11 wherein said thermal bridge comprises a thermally-conductive metal in thermal contact with said transformer core and said exhaust tubulation.

13. An electrodeless lamp assembly as defined in claim 11 wherein said thermal bridge comprises a thermally-conductive cement in thermal contact with said transformer core and said exhaust tubulation.

14. An electrodeless lamp assembly as defined in claim 10 wherein said amalgam is located in an exhaust tubulation of said lamp envelope and wherein said lamp assembly further comprises a core retainer disposed around said transformer core, said thermal connection between said transformer core and said amalgam comprising a thermal connection between said core retainer and said exhaust tubulation.

15. An electrodeless lamp assembly as defined in claim 10 wherein said amalgam is located in close proximity to said transformer core, wherein thermal energy is transferred from said transformer core to said amalgam through said lamp envelope.

16. A method for operating an electric lamp assembly comprising an electrodeless lamp including an electrodeless lamp envelope enclosing a fill material for supporting a low pressure discharge, said electrodeless lamp further including an amalgam at a predetermined location within said lamp envelope, a transformer core disposed in proximity to said lamp envelope and an input winding disposed on said transformer core, said method comprising the steps of:

supplying radio frequency energy to said input winding, said radio frequency energy producing said low pressure discharge in said lamp envelope; and controlling the temperature of the amalgam by coupling thermal energy from said transformer core to said amalgam during operation of said lamp assembly by means of a heat-conducting material.

17. A method as defined in claim 16 wherein said amalgam is located in an exhaust tubulation of said lamp envelope and wherein the step of controlling the temperature of the amalgam includes providing a thermal bridge between said transformer core and said exhaust tubulation.

18. A method as defined in claim 16 wherein said amalgam is located in an exhaust tubulation of said lamp envelope and wherein said electrodeless lamp further comprises a core retainer disposed around said transformer core, the step of controlling the temperature of the amalgam comprising providing a thermal connection between said core retainer and said exhaust tubulation.

* * * * *